US006545640B1

(12) United States Patent
Herve et al.

(10) Patent No.: US 6,545,640 B1
(45) Date of Patent: Apr. 8, 2003

(54) DUAL-BAND TRANSMISSION DEVICE AND ANTENNA THEREFOR

(75) Inventors: Pascal Herve, Paris (FR); Charles Ngounou Kouam, Les Ulis (FR); Jean-Philippe Coupez, Brest (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/868,067

(22) PCT Filed: Jun. 8, 2000

(86) PCT No.: PCT/FR00/01586

§ 371 (c)(1),
(2), (4) Date: Jun. 14, 2001

(87) PCT Pub. No.: WO01/35492

PCT Pub. Date: May 17, 2001

(30) Foreign Application Priority Data

Nov. 8, 1999 (FR) ..... 99 13976

(51) Int. Cl.[7] ..... H01Q 1/38
(52) U.S. Cl. ..... 343/700 MS; 343/846
(58) Field of Search ..... 343/700 MS, 702, 343/846, 826, 828; H01Q 1/38

(56) References Cited

U.S. PATENT DOCUMENTS 5,926,136 A 7/1999 Ohtsuka et al. ..... 343/700 MS
5,926,139 A * 7/1999 Korisch ..... 343/702
6,140,966 A * 10/2000 Pankinaho ..... 343/700 MS
6,252,552 B1 * 6/2001 Tarvas et al ..... 343/700 MS
6,252,554 B1 * 6/2001 Isohatala et al. ..... 343/700 MS
6,346,914 B1 * 2/2002 Annamaa ..... 343/700 MS

FOREIGN PATENT DOCUMENTS

| | | | |
|---|---|---|---|
| EP | 0 637 094 A1 | 2/1995 | H01Q/9/04 |
| EP | 0 892 459 A1 | 1/1999 | H01Q/9/04 |
| EP | 0 954 055 A1 | 11/1999 | H01Q/5/00 |
| GB | 2 150 356 A | 6/1985 | H01Q/9/40 |
| JP | 10-93332 | 4/1998 | H01Q/13/08 |
| JP | 11-251825 | 9/1999 | H01Q/13/08 |

* cited by examiner

*Primary Examiner*—Hoanganh Le
(74) *Attorney, Agent, or Firm*—Sughrue Mion, PLLC

(57) ABSTRACT

The antenna (1) of this system is a microstrip antenna. A rear edge (10) of the body (31) of its patch (6) is provided with a short-circuit (S) by which a quarter-wave type primary resonance can be excited from a connecting line (C1). A slot (17) penetrates the patch from its periphery and separates a body from a tail (33) which remains connected to the body by a passage (32). A secondary resonance mode utilises the body, the passage and the tail. It can be excited from the same connection line at a frequency which is twice that of the primary resonance. The short-circuit can be obtained by components attached to the edge of the substrate of the antenna and can then have inductive, resistive and controlled components. The invention applies in particular to implementing a two-mode mobile radio system using the GSM and DCS standards.

24 Claims, 4 Drawing Sheets

DUAL-BAND TRANSMISSION DEVICE AND ANTENNA THEREFOR

BACKGROUND OF THE INVENTION

The present invention relates generally to radio transmission systems, in particular mobile telephones, and more particularly to microstrip antennas included in such systems.

An antenna of this kind includes a patch which is typically formed by etching a metallic layer. The skilled person refers to an antenna of this kind as a "microstrip patch antenna".

Microstrip technology is a planar technology which is used both to produce signal transmission lines and antennas which provide coupling between such lines and radiated waves. It uses conductive patches and/or strips formed on the upper surface of a thin dielectric substrate. A conductive layer extends over the bottom surface of the substrate and constitutes a ground plane for the line or the antenna. A patch of the above kind is typically wider than a strip of the above kind and its shape and dimensions constitute important characteristics of the antenna. The substrate is typically a plane rectangular sheet of constant thickness and the patch is also typically rectangular. This is no way obligatory, however. In particular, the skilled person knows that varying the thickness of the substrate can increase the bandwidth of an antenna of the above kind and that the patch can take various shapes, for example it can be circular. The electric field lines extend through the substrate between the strip or the patch and the ground plane.

The above technology differs from various other technologies which also use conductive members on a thin substrate, and in particular it differs from coplanar line technology in which the electric field is established over the upper surface of the substrate and in a symmetrical manner between a central conductive strip and two conductive areas on respective opposite sides of the strip, from which they are respectively separated by two slots. In the case of a loop slot antenna, a patch is surrounded by a continuous conductive area from which it is separated by a slot.

Antennas constructed using the above technologies typically, although not necessarily, constitute resonant structures in which standing waves provide coupling with waves radiated into space.

Various types of resonant structure can be implemented using the microstrip technology and can employ various modes of resonance, which modes are referred to more briefly hereinafter as "resonances". Broadly speaking, each such resonance can be described as a standing wave formed by the superposition of two traveling waves propagating in two opposite directions on a common path, the two waves resulting from the same traveling electromagnetic wave being reflected alternately at each of the two ends of the path. In the context of a description of this kind, the wave is considered to propagate in an electromagnetic line comprising the ground plane, the substrate, and the patch, and which defines a linear path of zero width. In fact a wave of the above kind has wavefronts which extend transversely across the whole of the section offered to them by the antenna, which means that the above description simplifies the real-life situation in a manner that is sometimes excessive. To the extent that it can be considered linear, the path can be rectilinear or curved. It is referred to hereinafter as the "resonance path". The resonant frequency is inversely proportional to the time taken by the above-mentioned traveling wave to travel along this path.

A first type of resonance might be referred to as "half-wave" resonance. In this type of resonance the length of the resonance path is typically substantially equal to one half-wavelength, i.e. to half the wavelength of the traveling wave referred to above. The antenna is then referred to as a "half-wave" antenna. This type of resonance can generally be defined by the presence of an electric current node at each of the two ends of a path of the above kind, whose length can therefore be equal to said half-wavelength multiplied by an integer other than one. This integer is typically odd. Coupling with the radiated waves occurs at at least one of the two ends of the path, which ends are in regions where the amplitude of the electric field in the substrate is at a maximum.

A second type of resonance that can be obtained using the same technology might be referred to as "quarter-wave" resonance. It differs from said half-wave resonance firstly in that the resonance path typically has a length substantially equal to one fourth of a wavelength, i.e. one quarter of the wavelength as defined above. For this the resonant structure must have a short-circuit at one end of the path, the expression "short-circuit" referring to a connection between the ground plane and the patch. The short-circuit must have a sufficiently low impedance to be able to impose such resonance. This type of resonance can be generally defined by the presence of an electric field node fixed by a short-circuit of the above kind in the vicinity of if an edge of the patch and by an electric current node at the other end of the resonance path. The length of the resonance path can therefore be equal to an integer number of half-wavelengths added to said quarter-wavelength. Coupling with the waves radiated into space occurs at an edge of the patch, in a region where the amplitude of the electric field through the substrate is sufficiently high.

Other types of more or less complex resonance can be established in antennas of the above kind, each resonance being characterized by a distribution of the electric and magnetic fields, which fields oscillate in an area of space including the antenna and its immediate vicinity. They depend in particular on the configuration of the patches, which can in particular incorporate slots, possibly radiating slots. They also depend on the possible presence and location of short-circuits and electrical models representing those short-circuits when they are imperfect short-circuits, i.e. when they cannot be treated, even approximately, as equivalent to perfect short-circuits with zero impedance.

The presence of an imperfect short-circuit in an antenna can give rise to resonance featuring what might be referred to as a virtual node. A virtual node is produced if some of the following conditions are satisfied at the same time. If the above antenna is referred to as the "first antenna", these conditions are as follows:

- The distribution of the fields in the first antenna is substantially identical to a distribution that can be induced in an identical area of the patch of a second antenna.
- The second antenna is identical to the first antenna within this area except that within this area the second antenna does not have the short-circuit in question.
- The patch of the second antenna extends not only over the area already mentioned, which then constitutes a main area of the second antenna, but also over a complementary area.
- Finally, the distribution of the fields in question in the main area of the second antenna is accompanied by an electric or magnetic field node in the complementary area.

When describing the resonance occurring in the first antenna, the node occurring in the second antenna may be considered also to constitute a node for the resonance of the first antenna. For an antenna such as the first antenna, a node of this kind is referred to hereinafter as a "virtual" node, because it is in an area which is outside the patch of the antenna and in which no electric or magnetic field therefore occurs whereby the presence of the node could be determined directly.

Although these "virtual nodes" are not conventionally taken into account in these terms in describing resonances, they are implicit in the distinction that is sometimes drawn between the physical or geometrical length and the so-called electrical length of the same patch. In the case of two antennas referred to above, and with regard to the patch of the first antenna, the physical or geometrical length would be that of the patch and the electrical length of the same patch would in fact be the physical or geometrical length of the second antenna.

More than one resonance can occur for a given antenna configuration. They then enable the antenna to be used at each of the resonant frequencies.

An antenna is typically coupled to a signal processor such as a transmitter via a connection system including a connection line which is external to the antenna and terminates at a coupling system integrated into the antenna for coupling the line to a resonant structure of the antenna. The resonances of the antenna also depend on the nature and on the location of this system. In the case of transmit antennas, the connection system is often referred to as a feed line of the antenna.

The present invention relates to various types of systems such as mobile telephones, base transceiver stations for mobile telephones, automobiles and aircraft or airborne missiles. In the case of a mobile telephone, the continuous nature of the bottom ground plane layer of a microstrip antenna readily limits the radiation intercepted by the body of the user of the system. In the case of automobiles, and above all in the case of aircraft or missiles, whose outside surface is of metal and has a curved profile producing very low aerodynamic drag, the antenna can be conformed to that profile so as not to generate any unwanted additional aerodynamic drag.

The invention relates more particularly to the situation in which a microstrip antenna must have the following qualities:

- it must be a two-frequency antenna, i.e. it must be able to transmit and/or receive efficiently radiated waves at two frequencies separated by a large spectral spacing,
- it must be connectable to a signal processor by a single connection line for all operating frequencies of a transmission system without giving rise in that line to any unwanted and troublesome standing wave ratio, and
- it must not be necessary to use a frequency multiplexer or demultiplexer to achieve the above.

Many microstrip antennas have been constructed or proposed in the art which have the above three qualities. They differ from each other in terms of the means employed to obtain a plurality of resonant frequencies. Three such antennas are discussed below:

A first such prior art antenna is described in U.S. Pat. No. 4,766,440 (Gegan). The patch 10 of that antenna is of generally rectangular shape, enabling the antenna to exhibit two half-wave resonances whose paths are established along a length and across a width of the patch. It also has a U-shaped curved slot which lies entirely inside the patch. The slot is a radiating slot and produces an additional mode of resonance with another path. By an appropriate choice of its shape and dimensions, it also tunes the frequencies of the resonance modes to required values, which offers the facility to transmit a circularly polarized wave by associating two modes having the same frequency and crossed linear polarization. The coupling system takes the form of a microstrip line, but the line can also be said to be coplanar in that the microstrip is in the plane of the patch and penetrates between two notches therein. The system includes impedance matching means for matching it to the various input impedances of the line at the various resonant frequencies used as operating frequencies.

That first prior art antenna has the following drawbacks in particular:

- The need to provide impedance matching means makes it complicated.
- Accurate adjustment of the resonant frequencies to required values is difficult.

A second prior art antenna differs from the previous one in that it uses only one resonance path. It is described in U.S. Pat. No. 4,771,2 (LO et al.). Its patch includes localized short-circuits and slots extending along straight line segments inside the patch. The slots and short-circuits reduce the difference between two frequencies corresponding to two resonances which share said path but have two respective and mutually different modes which are designated by the numbers (0,1) and (0,3), i.e. the common path is occupied by one half-wave or by three half-waves according to the mode concerned. The ratio between these two frequencies can therefore be reduced from 3 to 1.8. The localized short-circuits are formed by conductors passing through the substrate.

That second prior art antenna has in particular the drawback that its fabrication is complicated by the inclusion of localized short-circuits.

A third prior art two-frequency antenna differs from the preceding antennas in that it uses quarter-wave resonance. It is described in the article: "Dual Band Cavity-Backed Quarter-wave Patch Antenna" by Boag et al. published in IEEE ANTENNAS AND PROPAGATION SOCIETY INTERNATIONAL SYMPOSIUM DIGEST, NEWPORT BEACH, JUN. 18–23, 1995, pages 2124–2027. A first resonant frequency is defined by the dimensions and the characteristics of the substrate and the patch of the antenna. A resonance of substantially the same type is obtained at a second frequency on the same resonant path by using a matching system.

That third prior art antenna has the following drawbacks in particular:

The difference between the two resonant frequencies is too small for some applications.

- The need to use a matching system makes the antenna complicated.
- The same can apply to using an antenna coupling system in the form of a coaxial line.

SUMMARY OF THE INVENTION

The present invention has the following objects in particular:

- to simplify implementing a two-frequency antenna,
- to enable a freer choice than previously of the ratio of the center frequencies of two operating bands of a transmission system, and more particularly of providing an antenna for this system such that the ratio of two wanted resonant frequencies of the antenna is from approximately 1.25 to approximately 5, and in particular close to 2,
- to give the antenna a bandwidth centered on each of the two resonant frequencies which is sufficiently large to enable a transmit frequency and a receive frequency of the system to be situated in each of the two bands without causing crosstalk, to enable easy and accurate adjustment of the two resonant frequencies, to enable the use of a single coupling system whose impedance can easily be matched for each of the two resonant frequencies, and to limit the dimensions of the antenna.

With the above objects in view, the invention provides in particular a two-band transmission system including:

a signal processor adapted to be tuned in two operating bands centered on respective predetermined center frequencies to transmit and/or receive an electrical signal in each of the two bands, a microstrip antenna, and an antenna connection system including electrical conductors connecting the processor to the antenna for coupling said electrical signal to radiated waves, wherein the antenna includes:

a conductive ground plane, a conductive patch having a periphery, a short-circuit formed at said periphery, and a separator slot having an origin consisting of an opening in said periphery, said slot penetrating said patch from said origin, wherein said short-circuit and said separator slot enable two resonances to be established in said antenna, one of said two resonances is of the quarter-wave type with an at least virtual electric field node fixed by said short-circuit, constitutes a primary resonance and has a primary frequency substantially equal to one of said two center frequencies, and the other of said two resonances constitutes a secondary resonance having a secondary frequency substantially equal to the other of said two center frequencies, and wherein said electrical conductors of the connection system include said ground plane and a main antenna coupling conductor which is part of said patch to enable said antenna to be coupled to said signal processor around each of said two center frequencies, which transmission system is characterized in that said separator slot extends in said patch as far as a rear end of said slot located at a sufficiently small distance from said periphery for said slot to divide said patch partly into a body including said main antenna coupling conductor and said short-circuit and a tail free of said short-circuit and electrically connected to said connection system only by means of said body and a passage consisting of an area of said patch between said back and said periphery.

The separator slot is preferably at a distance from the periphery of the patch greater than the distance from the rear end of the slot to the periphery over all of its length except in the vicinity of its origin or at least over a major portion of its length and on both sides.

The origin of the separator slot is preferably near said short-circuit so as to confer on said two resonances respective resonance paths which both extend from said short-circuit, one of said two paths preferably extends only in said body and the other of said two paths preferably extends in said body and in said tail.

BRIEF DESCRIPTION OF THE DRAWINGS

Various aspects of the present invention will be understood better in the light of the following description and the accompanying diagrammatic drawings. If two components are designated in more than one of the figures by the same reference numbers and/or letters, they have the same function in two embodiments of the invention or they are the same component.

DETAILED DESCRIPTION OF THE INVENTION

Figure 1:
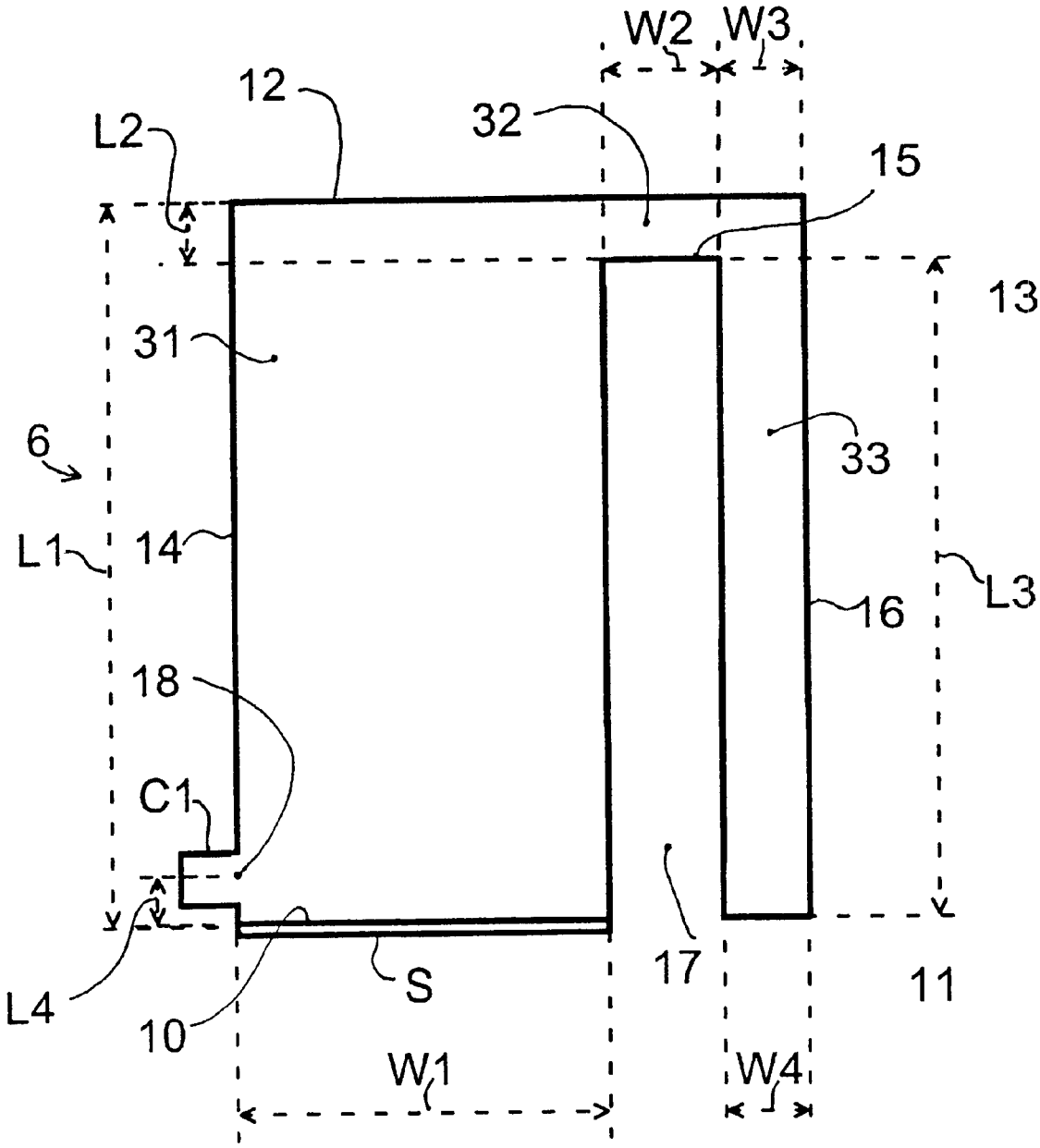
FIG. 1 shows the patch of a first embodiment of an antenna in accordance with the invention.
Figure 2:
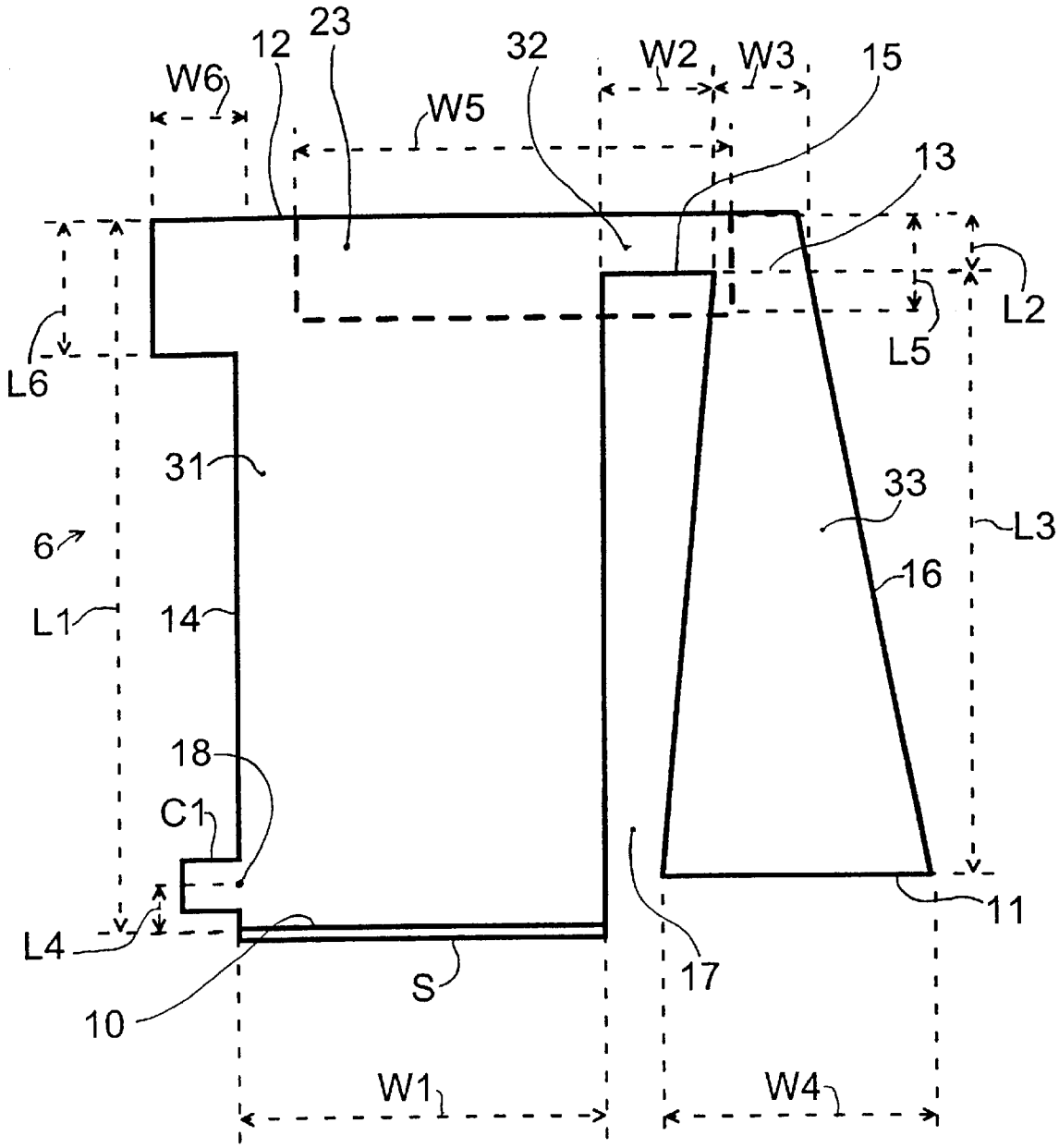
FIG. 2 shows the patch of a second embodiment of an antenna in accordance with the invention.
Figure 3:
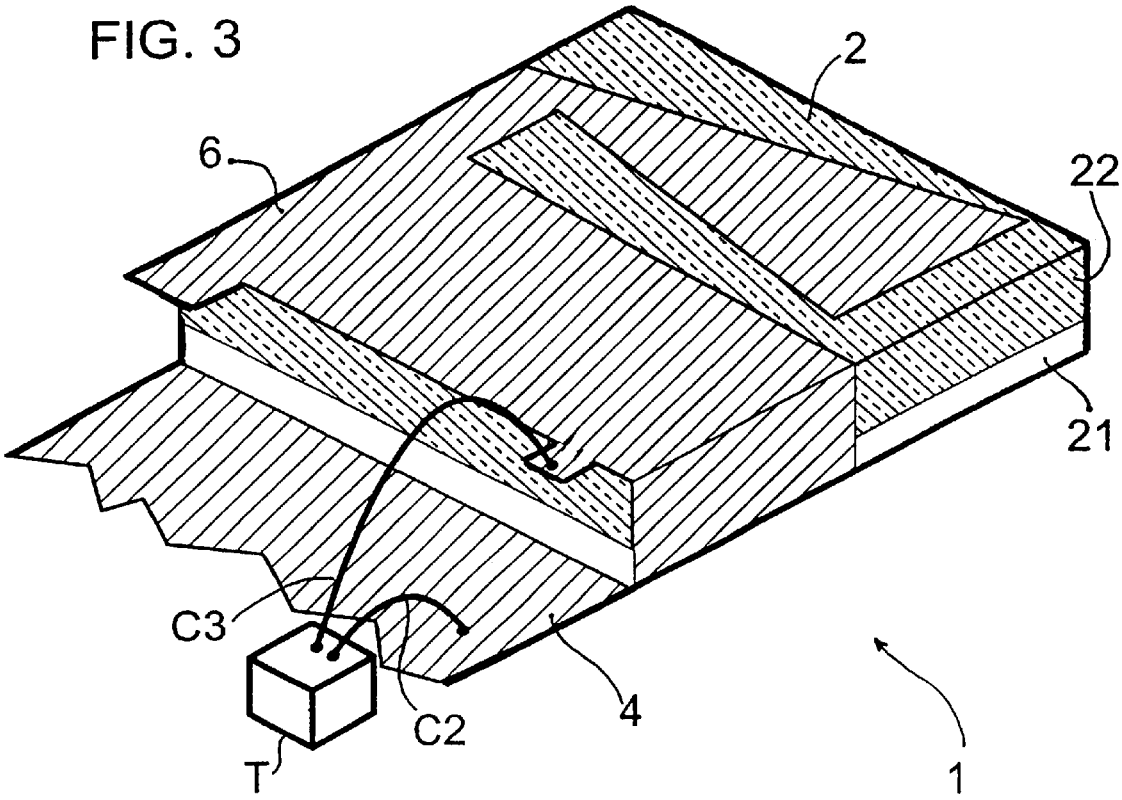
FIG. 3 is a perspective view of a transmission system including the antenna whose patch is shown in FIG. 2.

As shown in FIGS. 1 to 3, and as known in the art, the resonant structure of an antenna in accordance with the invention includes the following components:

A dielectric substrate 2 having two mutually opposed main surfaces extending in horizontal directions DL and DT defined relative to the antenna and which can depend on the area of the antenna concerned. The substrate can take various forms, as already explained. Its two main surfaces respectively constitute a bottom surface Si and a top surface S2.

A bottom conductive layer extending over the whole of the bottom surface, for example, and constituting a ground plane 4 of the antenna.

A top conductive layer extending over an area of the top surface above the ground plane 4 to constitute a patch 6. The patch generally has a length and a width extending in two horizontal directions respectively constituting a longitudinal direction DL and a transverse direction DT, and its periphery can be considered as being made up of four edges extending in pairs substantially in these two directions. Although the terms "length" and "width" usually apply to two mutually perpendicular dimensions of a rectangular object, the length being greater than the width, it must be understood that the patch 6 can depart widely from a rectangular shape without departing from the scope of the present invention. One of these edges extends generally in the transverse direction DT and constitutes a rear edge including two segments 10 and 11. A front edge 12 is on the opposite side to the rear edge. Two lateral edges 14 and 16 join the rear edge to the front edge.

Finally, a short-circuit electrically connecting the patch 6 to the ground plane 4 from the segment 10 of the rear edge of the patch. In first and second embodiments of the invention, the short-circuit is formed by a conductive layer S extending over an edge surface of the substrate 2, which surface is typically plane and then constitutes a short-circuit plane. In a third embodiment, it is constituted by three discrete components R, L and D connected in parallel between the ground plane 4 and the patch 6. In each embodiment, it obliges at least one resonance of the antenna to have an at least virtual electric field node in the vicinity of the segment 10 and to be of the quarter-wave type. This resonance and its frequency are referred to hereinafter as the "primary resonance" and the "primary frequency". Said rear, front and lateral edges and the longitudinal and transverse directions are defined by the position of a short-circuit of this kind to the extent that the short-circuit is sufficiently large, i.e. in particular its impedance is sufficiently low, to impose a resonance in the antenna having an electric field node of this kind.

The antenna further includes a coupling system. The coupling system includes a main conductor consisting of a coupling strip C1 on the top surface S2 of the substrate. This strip is connected to the patch 6 at a connection point 18 which can be on the leading edge 14, for example. The distance from the rear edge 10 to this point constitutes a connection dimension. The system further includes a conductive ground plane consisting of the layer 4. It is part of a connection system which connects the resonant structure of the antenna to a signal processor T, for example to excite one or more resonances of the antenna from that processor when it is a transmit antenna. In addition to this system, the connection system typically includes a connection line which is external to the antenna. This line can be of the coaxial, microstrip, or coplanar type in particular. In FIG. 1 it is symbolized by two conductive wires C2 and C3 respectively connecting the ground plane 4 and the strip C1 to the two terminals of the signal processor T. However, it must be understood that in practice this line preferably takes the form of a microstrip line or a coaxial line.

The signal processor T is adapted to operate at predetermined operating frequencies which are at least close to the wanted resonant frequencies of the antenna, i.e. which are in bands centered on those resonant frequencies. It can be a composite system and can then include a component tuned permanently to each of the operating frequencies. It can instead include a component which can be tuned to the various operating frequencies. Said primary resonant frequency constitutes one such wanted resonant frequency.

In accordance with the present invention, the separator slot 17 extends from the rear edge 10,11 of the patch to a rear end 15 of the slot away from the lateral edges 14 and 16 and the front edge 12. The body 31 is therefore connected to the tail 33 by a tail connecting passage 32. This passage has a length W2 in the direction DT and a width L2 in the direction DL between the leading edge 14 and the rear end 15. The body has a width W1 in the direction DT. The slot 17 divides the rear edge into a body base 10, which is part of the body 31 and includes the short-circuit S, and a tail base 11, which is part of the tail 33 and has a width W4 in the transverse direction DT. A tip 13 of the tail consists of the area where the tail joins onto the passage 32. The length of the tail extends in the direction DL from the base 11 to the tip. A width of the tail is defined at each point of the length and extends in the direction DT.

In the context of the first embodiment of the invention, shown in FIG. 1, the width of the body, the passage and the tail of the patch are uniform and an antenna whose patch is formed in this way can satisfy the requirements which are generally encountered in the mobile telephone art in that its primary and secondary frequencies can be in a ratio close to 2:1.

A second embodiment nevertheless appears to be preferable over the first embodiment. In the second embodiment, the width W4 of the base 11 of the tail 33 is greater than the width W2 of its tip 13. The width of the tail preferably increases from its tip to a base, passing through multiple intermediate values between the widths of the tip and the base. This increase in the width of the tail is even more preferably continuous, and the tail is the shape of a trapezium, for example, whose large and small bases are respectively the base and the tip of the tail.

The length L3 of the tail 33 is more preferably from 50% to 100% of the length L1 of the body 31 and the ratio F2/F1 of the secondary frequency F2 to the primary frequency F1 is preferably from 1.9 to 2.1.

The width W4 of the base 11 of the tail 33 is more preferably from 50% to 150% of the width W1 of the body 31. Moreover, if the passage 32 and the tip 13 of the tail are considered to constitute a connection system for the tail, and if a narrower width of the combination constitutes an effective tail connection width, then that effective width W3 is preferably from 10% to 70% of the width W4 of the base.

In the second and third embodiments of the invention, the substrate 2 preferably includes in at least part of its area two mutually distinct and superposed layers respectively constituting a bottom dielectric layer 21 carrying the ground plane 4 and a top dielectric layer 22 carrying the patch 6. The top dielectric layer advantageously has a higher permittivity than and is thinner than the bottom dielectric layer and the two layers advantageously extend over the entire area of the substrate. This difference between the two layers has the advantage of increasing long-range radiation efficiency. It also facilitates adjusting the resonant frequencies.

The antenna preferably further includes a conductive insert 23 extending between the top and bottom dielectric layers 21 and 22 in a portion of the area of the patch 6. This portion advantageously extends under the passage 32 and in the vicinity of the front edge 12. The insert can have a width L5=5 mm and a length W5=20 mm, with the middle of the length coinciding with the middle of the front edge 12. It has the advantage that the secondary frequency can be adjusted by choosing its position and dimensions without modifying the primary frequency in a troublesome manner.

In a variant that is not shown, the same advantage could be obtained by using a tongue consisting of copper film continuous with the body 31 and projecting from it and from the substrate at the front edge 12. A tongue of this kind can be bent over this edge at will, away from the plane of the patch and towards the vertical plane of the substrate. The required frequency adjustment is then effected by choosing its inclination.

In the context of said first and second embodiments, various compositions and values are indicated hereinafter by way of example. The length and the width of the substrate are respectively indicated in the longitudinal direction DL and the transverse direction DT. The antenna ground plane covers the bottom face of the substrate. The short-circuit S occupies all of the width of the base of the body 31.

The following values are valid for each of the two embodiments:

primary resonant frequency: F1=980 MHz, secondary resonance frequency: F2=1900 MHz, input impedance: 50 ohms, composition of conductive layers: copper, thickness of these layers: 17 microns, width of conductor C1: 5 mm.

The following values are valid for the first embodiment:

length of substrate: 30 mm, width of substrate: 20 mm, composition of substrate: laminate based on a fluoropolymer such as PTFE having a relative permittivity $\epsilon r$ equal to 5 and a dissipation factor tan $\delta$ equal to 0.002, thickness of substrate: 5 mm, length of patch: 20 mm, width of body of patch: 13 mm, connection dimension: 2 mm, width of separator slot: 3 mm, length of that slot: 25 mm, width of tail: 4 mm, and bandwidth centered on primary and secondary frequencies: 2.5% and 2% of those frequencies, respectively, measured at standing wave ratios less than or equal to 3.5.

The following values are valid for the second embodiment of the invention:

length of substrate: 32 mm, width of substrate: 26 mm, composition of substrate bottom layer 21: low-permittivity foam, thickness of this bottom layer: 2 mm, composition of substrate top layer 22: laminate based on a fluoropolymer such as PTFE having a relative permittivity $\epsilon r$ equal to 5 and a dissipation factor tan $\delta$ equal to 0.002, thickness of this top layer: 3 mm, length of patch: L1=32 mm, width of body of patch: W1=12 mm, connection dimension: L4=2 mm, length of passage: W2=4 mm, width of passage: L2=2 mm, tail 33: symmetrical about an axis parallel to leading edge 14, width of tip 13 of tail 33: W3=2 mm, width of base 11 of tail 33: W4=12 mm, length of tail 33: L3=30 mm, bandwidth centered on primary and secondary frequencies: 3.5% and 4% of those frequencies, respectively, measured at standing wave ratios less than or equal to 3.5.

Operation of these two embodiments of antenna will now be described.

The coupling between the standing wave of each of the primary and secondary resonances, on the one hand, and the wave radiated into space, on the other hand, occurs principally at one end of the patch 6. This edge is referred to as the primary or secondary radiating edge, depending on the resonance concerned.

In the first embodiment of the invention the primary radiating edge is the front edge 12, which corresponds to a primary resonance of the quarter-wave type having an electric field node on the segment 10. However, the primary frequency is found to have a value suggesting that the path of that resonance has been slightly lengthened by the presence of the passage 32 and the tail 33. If the length of the patch were imposed, such lengthening would enable a lower value of the primary frequency with the slot 17 present than with it absent. In the typical situation in which it is the value of the primary frequency which is imposed, the presence of the slot enables the length of the patch to be reduced, which is an advantage and generally a design objective. This advantage would remain if the antenna were included in a single-band transmission system using only the primary resonance of the antenna.

In the first embodiment, the secondary radiating edge consists of the base 11 of the tail 33. The secondary frequency is found to have a value suggesting that the path of the secondary resonance, from the short-circuit S, follows not only the length of the body 31, but also those of the passage 32 and the tail 33, and that the resonance is essentially a half-wave type resonance, although the length of its path is close to three-quarters of the wavelength, with two electric field nodes, one of which is imposed by the short-circuit S and the other of which is close to the tip 13 of the tail 33.

In the second embodiment of the invention the primary radiating edge is the base 11 of the tail 33 and the primary frequency is found to have a value suggesting that the quarter-wave type rimary resonance path, from the short-circuit S, follows not only the length of the body 31 but also those of the passage 32 and the tail 33. In a typical situation in which it is the value of the primary frequency which is imposed, the presence of the slot 17 therefore enables the length of the patch to be reduced more than in the first embodiment.

In the second embodiment, the secondary radiating edge is the front edge 12. The secondary frequency is found to have a value suggesting that the secondary resonance path extends the length of the body 3 and that the resonance is essentially a quarter-wave type resonance.

Figure 5:
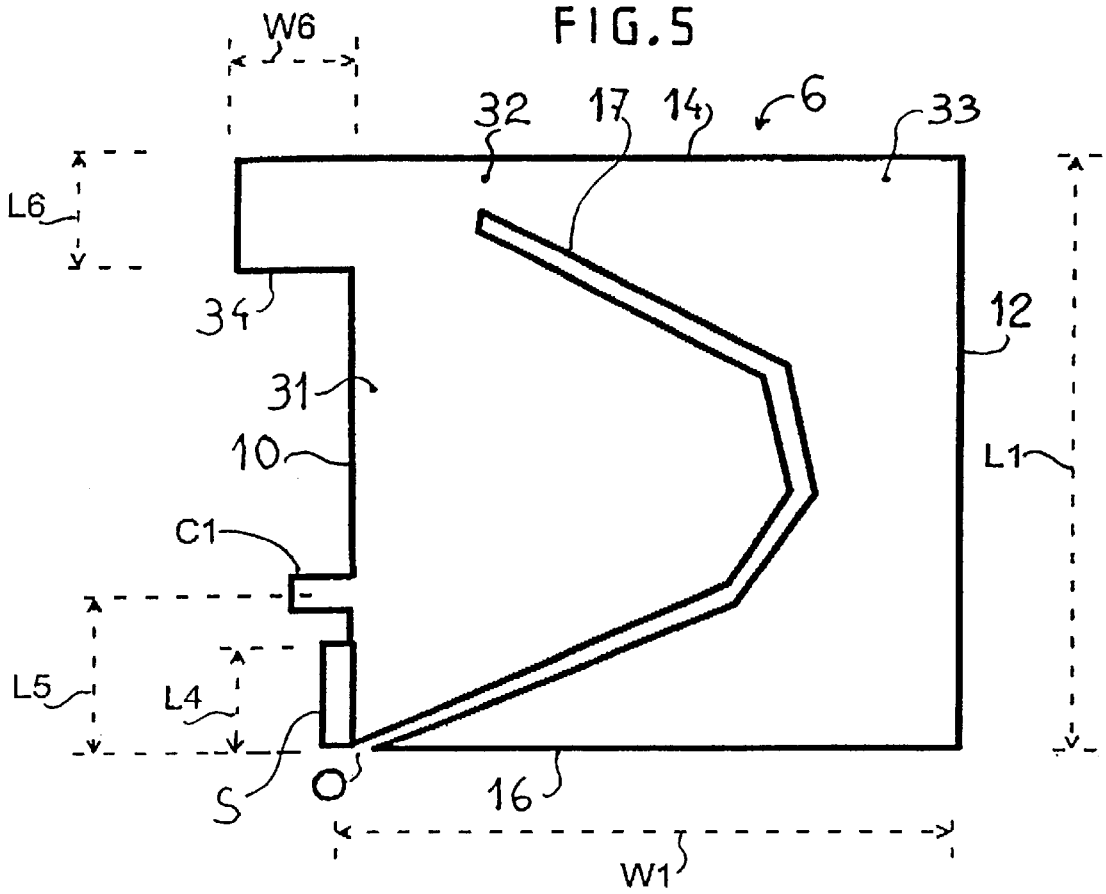
FIG. 5 shows the patch of a preferred fourth embodiment of an antenna in accordance with the invention.

As shown in FIG. 2, for the second embodiment, the body 31 is preferably provided with an excrescence 34 in the plane of the patch 6 and projecting from the leading edge 14 in the vicinity of the front edge 12. In the context of the invention it has been found that an excrescence of this kind has the advantage of increasing the bandwidths of the resonances of the antenna. The excrescence can be rectangular, in which case it has a length L6=10 mm and a width W6=6 mm. An excrescence 34 of this kind in the fourth embodiment of the invention is shown in FIG. 5, in which it projects from the rear edge 10 in the vicinity of the leading edge 14.

Figure 4:
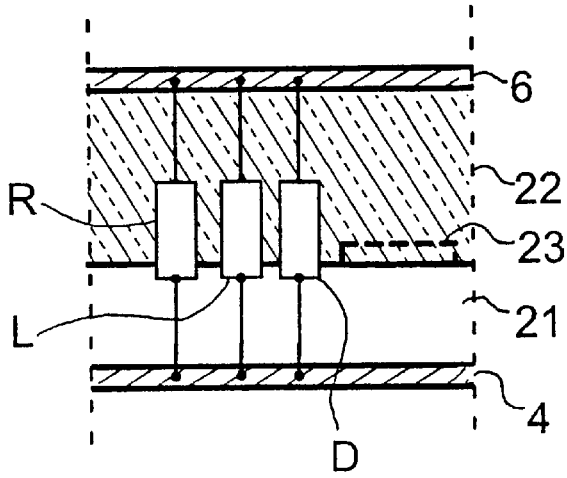
FIG. 4 is a partial view of the rear of a third embodiment of an antenna in accordance with the invention.

In an arrangement shown in FIG. 4 and used in the third embodiment of the invention, which is the preferred embodiment in some applications of the invention, the short-circuit has a relatively high impedance at the primary frequency and the primary resonance is therefore substantially different from the resonance that could be induced in the antenna in the vicinity of that frequency if the short-circuit had zero impedance. At the same time, this impedance is relatively low at this frequency to fix an electric field node of the resonance in the vicinity of the base 10 of the body 31, which node is at least virtual. This has the drawback of complicating the short-circuit. However, it has the advantage, which is sometimes a major advantage, that an appropriate choice in accordance with the invention for the components of this impedance matches the resonances or physical characteristics of an antenna to the use of the antenna better than if the short-circuit had zero impedance.

More particularly, the impedance of the shortcircuit preferably has an inductive component L. An inductive component of this kind produces a quarter-wave type resonance with a virtual electric field node to the rear of the base 10, i.e. outside the patch 6. This obtains the advantage of enabling the length of the patch to be further reduced if the frequency F1 of the primary resonance is imposed.

The impedance of the short-circuit can also have a resistive component R, which offers the advantage of increasing the bandwidths of the antenna. It can also have a controlled component in the form of a diode D shunted by a decoupling capacitor (not shown). A component of this kind has the advantage of enabling the frequency or the bandwidth of the resonance of the antenna to be controlled. Such components are readily implemented using at least one discrete component connected between the patch 6 and the ground plane 4.

The advantages referred to above as being related to the choice of the components of the impedance of a short-circuit imposing a quarter-wave type resonance would also be obtained in an antenna in which only this resonance were used and/or in an antenna whose patch did not include the slot 17 previously described.

In the second and third embodiments of the invention the substrate 2 preferably includes in at least part of its area two mutually distinct and superposed layers respectively constituting a bottom dielectric layer 21 carrying the ground plane 4 and a top dielectric layer 22 carrying the patch 6. The top dielectric layer advantageously has a higher relative permittivity than, and is possibly thinner than, the bottom dielectric layer, and the two layers extend over the whole area of the substrate. This difference between the two layers has the advantage of increasing long-range radiation efficiency. It also facilitates adjusting the resonant frequencies.

The antenna more preferably includes a conductive insert 23 in a portion of the area of the patch 6 between the bottom dielectric layer 21 and the top dielectric layer 22. This portion advantageously extends under the passage 32 and in the vicinity of the front edge 12. The insert can have a width L5=5 mm and a length W5=20 mm with the middle of the length coinciding with the middle of the front edge 12. It has the advantage that the secondary frequency can be adjusted by choosing its position and its dimensions without modifying the primary frequency in a bothersome manner.

In an embodiment that is not shown, the same advantage could be obtained by means of a tongue consisting of a thin copper film continuous with the body 31 and projecting from it and from the substrate at the front edge 12. A tongue of this kind can be bent at will at this edge to move it away from the plane of the patch or towards the vertical plane of the edge of the substrate. The required frequency adjustment is then obtained by choosing its inclination.

As shown in FIG. 5, the fourth embodiment of an antenna in accordance with the invention differs from the preceding antennas in particular by virtue of the fact that the origin 0 of the separator slot 17 and the short-circuit S are close to the point common to the rear side 10 and the tail side 16. The edges of the separator slot are concave on the same side as the body 31 and convex on the same side as the tail 33 in order to impart to the two resonances two resonance paths both extending from the short-circuit. One of the two paths extends only in the body and the other extends in the body and in the tail. What is more, the antenna coupling strip C1 and the excrescence 34 join at the rear edge 10. This antenna has in particular the advantage of a high bandwidth.

Figure 6:
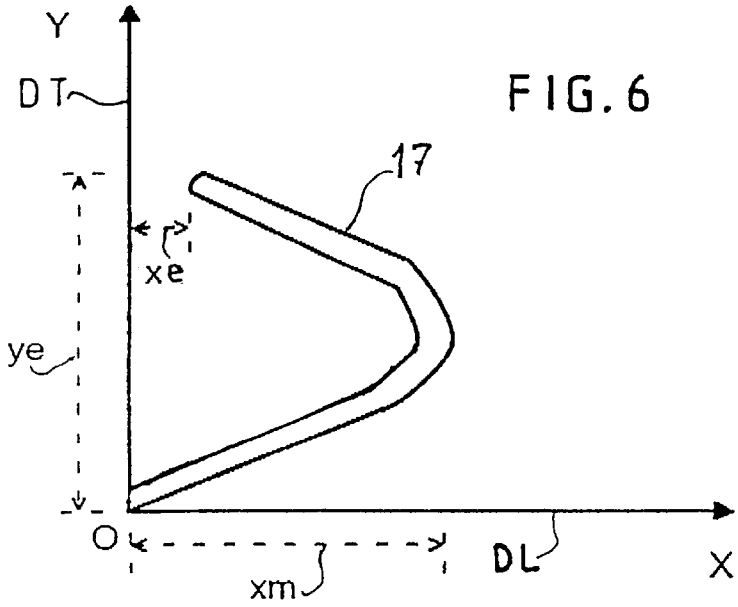
FIG. 6 shows the separator slot of the patch shown in FIG. 5.

In the context of the fourth embodiment, various compositions and values are given hereinafter by way of example. As shown in FIG. 6, lengths and widths are respectively indicated in the longitudinal direction DL and the transverse direction DT. Abscissas "x" and ordinates "y" are respectively measured in these same directions from the origin of the separator slot at the periphery of the patch. The ground plane of the antenna covers the bottom face of the substrate.

primary resonant frequency: F1=910 MHz, secondary resonance frequency: F2=1800 MHz, bandwidths centered on primary and secondary frequencies: 9% and 8% of those frequencies, respectively, measured at standing wave ratios less than or equal to 3, input impedance: 50 ohms, composition of conductive layers: copper, thickness of these layers: 200 microns, composition of substrate: foam having a relative permittivity sr equal to 1 and a dissipation factor tan δ equal to 0.0001, thickness of substrate: 7 mm, length of patch 6: W1=24 mm, width of body of patch: L1=35 mm, width of strip C1: 1.5 mm, width of short-circuit S: L4=3.5 mm, connection dimension: L5=5 mm, width of separator slot 17: 1.5 mm, length of that slot: 50 mm, maximum abscissa "xm" reached on path of slot: 21 mm, abscissa "xe" of end of slot: 8 mm, ordinate "ye" of end of slot: 32 mm, maximum width of excrescence 34: L6=5 mm, maximum length of excrescence: W6=10 mm.

Adjusting the dimensions of the excrescence provides fine adjustment of the spectral positions of the bands of the antenna.

In this fourth embodiment, the front edge 12 and the tail edge 16 each constitute a primary radiating edge and the primary frequency is found to have a value suggesting that the quarter-wave type primary resonance path from the short-circuit S follows not only the body 31 as far as the passage 32 but also a length of the tail 33. In this embodiment the leading edge 14, the rear edge of the slot 17 and the rear edge 10 of the patch each constitute a secondary radiating edge and the secondary frequency is found to have a value suggesting that the secondary resonance path is contained in the body 31 and that the resonance is of a relatively complex type.

The invention also provides an antennas as previously described.

It is applicable in particular to a mobile telephone system. A mobile telephone system includes base transceiver stations and mobile terminals and can be implemented under a GSM standard using frequencies close to 900 MHz and/or under a DCS standard using frequencies close to 1800 MHz. In a system of this kind base transceiver stations or mobile terminals can each include a transmission system according to the invention. In a system of this kind suited to this use, the antenna is able to operate in a high frequency band in the vicinity of said secondary frequency and in a low frequency band in the vicinity of said primary frequency. The processor T can then be tuned to four mutually distinct operating frequencies, namely:

a high transmit frequency in the high frequency band, a high receive frequency in the high frequency band, a low transmit frequency in the low frequency band, and a low receive frequency in the low frequency band.

It is adapted respectively to transmit or to receive a signal when it is tuned to one of said transmit frequencies or to one of said receive frequencies.

The invention makes each of the two frequency bands sufficiently wide not only to prevent crosstalk between transmit and receive channels in the band but also to enable the position of the channels in the band to be chosen from several options. The low frequency band corresponds to the GSM standard and the high frequency band to the DCS standard. This is an economical way of implementing base transceiver stations and/or two-mode terminals, i.e. terminals adapted to operate in the context of either of the above standards.

For example, the high transmit and receive frequencies can be 1750 MHz and 1840 MHz, respectively, and the low transmit and receive frequencies can be 890 MHz and 940 MHz, respectively.

What is claimed is:

1. A two-band transmission system including:

a signal processor adapted to be tuned in two operating bands centered on respective predetermined center frequencies to transmit and/or receive an electrical signal in each of the two bands, a microstrip antenna, and an antenna connection system including electrical conductors connecting the processor to the antenna for coupling said electrical signal to radiated waves, wherein the antenna includes:

a conductive ground plane, a conductive patch having a periphery, an electric substrate positioned between said conductive ground plane and said conductive patch, a short-circuit formed at said periphery, and a separator slot having an origin consisting of an opening in said periphery, said slot penetrating said patch from said origin, wherein said short-circuit and said separator slot enable two resonances to be established in said antenna, one of said two resonances is of the quarter-wave type with an at least virtual electric field node fixed by said short-circuit, constitutes a primary resonance and has a primary frequency substantially equal to one of said two center frequencies, and the other of said two resonances constitutes a secondary resonance having a secondary frequency substantially equal to the other of said two center frequencies, and wherein said electrical conductors of the connection system include said ground plane and a main antenna coupling conductor which is part of said patch to enable said antenna to be coupled to said signal processor around each of said two center frequencies, which transmission system is characterized in that said separator slot extends in said patch as far as a rear end of said slot located at a sufficiently small distance from said periphery for said slot to divide said patch partly into a body including said main antenna coupling conductor and said short-circuit and a tail free of said short-circuit and electrically connected to said connection system only by means of said body and a passage consisting of an area of said patch between a back and said periphery.

2. The transmission system according to claim 1, said system being characterized in that said separator slot is at a distance from said periphery greater than the distance from said back to said periphery over a major portion of its length and on both sides.

3. The transmission system according to claim 1, said system being characterized in that said separator slot is at a distance from said periphery greater than the distance from said back to said periphery over all of its length and on both sides except in the vicinity of said origin.

4. The transmission system according to claim 1, said system being characterized in that said origin of the separator slot is near said short-circuit so as to confer on said two resonances respective resonance paths which both extend from said short-circuit, one of said two paths extends only in said body and the other of said two paths extends in said body and in said tail.

5. The transmission system according to claim 4, said system being characterized in that the edges of said separator slot are concave on the same side as said body and convex on the same side as said tail.

6. The transmission system according to claim 1, wherein said antenna includes:

said electrical substrate which has two mutually opposed main surfaces which extend in horizontal directions of said antenna and respectively constitute a bottom surface and a top surface, a bottom conductive layer which extends over said bottom surface and constitutes said ground plane of said antenna, a top conductive layer which extends over an area of said top surface over said ground plane and constitutes said patch, said short-circuit, which electrically connects said patch to said ground plane from a segment of said periphery of said patch, and an antenna coupling system forming part of said antenna connection system.

7. The transmission system according to claim 6, said system being characterized in that said antenna coupling system is a microstrip line including:

a strip constituting said main antenna coupling conductor, and said ground plane.

8. The transmission system according to claim 6, said system being characterized in that said patch is of generally rectangular shape and said periphery includes:

an edge provided with the short-circuit and constituting a rear edge, an edge opposite said rear edge and constituting a front edge, and two lateral edges joining said rear edge to said front edge and respectively constituting a leading edge and a tail edge, and in which system a length of said patch extends between said rear edge and said front edge in a longitudinal direction constituting one of said horizontal directions and a width of said patch extends between its two lateral edges in one of said horizontal directions constituting a transverse direction.

9. The transmission system according to claim 8, said system being characterized in that said body has an excrescence extending in the plane of said patch in the vicinity of said passage.

10. The transmission system according to claim 8, said system being characterized in that said separator slot extends from said rear edge of the patch to said front edge as far as a rear end of said slot at a distance from said two lateral edges and said front edge, whereby said body is connected to said tail by a passage having a length and a width, said length extends in said transverse direction, said width extends in said longitudinal direction between said front edge and said back of said slot, said slot separates said rear edge into a body base forming part of said body and provided with said short-circuit and a tail base forming part of said tail, said tail base has a width in said transverse direction, a tip of said tail consists of the area where said tail joins with said passage and has a width extending in said transverse direction, said tail has a length extending in said longitudinal direction from said tail base to said tip, and a width of said tail is defined at each point of said length and extends in said transverse direction.

11. The transmission system according to claim 10, said system being characterized in that said width of the base of the tail is greater than said width of the tip of said tail.

12. The transmission system according to claim 11, said system being characterized in that said width of the tail increases from said tip to said base of said tail through a plurality of intermediate values between said widths of said tip and said base.

13. The transmission system according to claim 12, said system being characterized in that said length of the tail is from 50% to 100% of said length of the body and the ratio of said secondary frequency to said primary frequency is from 1.9 to 2.1.

14. The transmission system according to claim 12, said system being characterized in that said width of the base of the tail is from 50% to 150% of said width of the body, said passage and said tip of said tail constitute a connecting system of said tail, a narrower width of said system constitutes an effective tail connection width and this effective width is from 10% to 70% of said width of said base.

15. The transmission system according to claim 8, said system being characterized in that said origin of the separator slot and said short-circuit are near the point common to said rear side and said tail side, the edges of said separator slot are concave on the same side as the body and convex on the same side as said tail, so as to impart two said two resonances two resonance paths respectively extending from said short-circuit, and one of said two paths extends only in said body and the other extends in said body and in said tail.

16. The transmission system according to claim 6, said system being characterized in that said short-circuit has a relatively high impedance at said primary frequency so that said primary resonance is substantially different from a resonance that could be induced in said antenna in the vicinity of said frequency if said short circuit had no impedance, said impedance is at the same time relatively low at said frequency to fix an electric field node of said resonance in the vicinity of said short-circuit and said node is at least virtual.

17. The system according to claim 16, said system being characterized in that said impedance of the short-circuit has an inductive component.

18. The system according to claim 16, said system being characterized in that said impedance of the short-circuit has a resistive component.

19. The system according to claim 16, said system being characterized in that said impedance of the short-circuit has a controlled component.

20. The system according to claim 16, said system being characterized in that said short-circuit includes at least one discrete component connected between said patch and said ground plane of the antenna.

21. The system according to claim 6, said system being characterized in that a dielectric substrate includes in at least part of its area two mutually distinct and superposed layers respectively constituting a bottom dielectric layer carrying said ground plane and a top dielectric carrying said patch.

22. The system according to claim 21, said system being characterized in that said top dielectric layer has a higher relative permittivity than said bottom layer and said two layers extend all over the area of said substrate.

23. The system according to claim 21, said system being characterized in that said antenna includes a conductive insert extending in a portion of the area of said patch between said bottom dielectric layer and said top dielectric layer and said portion extends at least under said passage.

24. The transmission system of claim 1, wherein a width of said separator slot is less at said opening than a width of said separator slot at a portion of said separator slot proximal to said rear end.

* * * * *